United States Patent [19]

Miller et al.

[11] 4,015,547

[45] Apr. 5, 1977

[54] SUPPORTING DEVICE FOR BLAST-FURNACE HOT-BLAST MAIN

[76] Inventors: Viktor Yakovlevich Miller, Perekopskaya ulitsa, 11, korpus 4, kv. 41; Gennady Petrovich Kandakov, Sevastopolsky prospekt, 51, korpus, 2, kv. 163; Alexandra Moiseevna Kuznetsova, Meierovsky proezd, 1/1, korpus 1, kv. 100, all of Moscow, U.S.S.R.

[22] Filed: Mar. 10, 1976

[21] Appl. No.: 665,416

Related U.S. Application Data

[63] Continuation of Ser. No. 564,049, April 1, 1975, abandoned.

[52] U.S. Cl. ..... 110/56; 122/510; 165/81

[51] Int. Cl.[2] ..... F23L 15/00; F28F 9/00

[58] Field of Search ..... 110/56; 122/510; 165/81; 138/106, 107

[56] References Cited

UNITED STATES PATENTS

| | | | |
|---|---|---|---|
| 2,228,819 | 1/1941 | Emmet | 122/510 |
| 3,204,613 | 9/1965 | Smith | 122/510 |
| 3,236,295 | 2/1966 | Yurko | 165/81 |
| 3,242,976 | 3/1966 | Morton | 165/81 |

*Primary Examiner*—Kenneth W. Sprague
*Attorney, Agent, or Firm*—Holman & Stern

[57] ABSTRACT

The ends of hot-blast air main hangers are connected to a carrying beam through the medium of pre-compressed springs, preferably each of the springs is in the form of a set of disk springs. The precomposition force of these springs is substantially equal to the mass of a section of the hot-blast main supported by the carrying beam. The magnitude of the pre-compressed setting of the springs is several times larger than the maximum displacements of air heater connecting pipes when the air heaters are vertically displaced during their operation.

3 Claims, 4 Drawing Figures

SUPPORTING DEVICE FOR BLAST-FURNACE HOT-BLAST MAIN

This is a continuation of application Ser. No. 564,049 filed Apr. 1, 1975, now abandoned.

BACKGROUND OF THE INVENTION

The present invention relates to improvements in blast-furnace equipment and more particularly to improvements in the supports for a blast-furnace hot-blast main.

The hot-blast main is used to supply a blast furnace with air heated in air heaters.

The hot-blast main consists of a trunk section rigidly and airtightly connected to the air heaters through hot-blast connecting pipes, and a bustle pipe section joined to the blast furnace by means of tuyere connections. The hot-blast main is manufactured of large diameter (1700 to 3500 mm) welded steel tubing lined inside with refractory materials.

The hot-blast main usually supplies the blast furnace with air heated up to 1000° C at up to 3 atm pressure.

At present, the average hot-blast temperature in modern blast-furnace installations is up to 1200° C with anticipated increases up to 1400° C at blast pressures up to 5 atm. These increased temperatures help to reduce coke consumption and, consequently, the cost of the cast iron produced.

In the majority of the known designs of hot-blast mains the trunk section with the connecting pipes forms in a horizontal plane a rigid three- or four-span (depending on the number of air heaters) frame, with the air heaters used as supports. In a vertical plane, this structure is, as a rule, suspended at several points by means of flexible rods from carrying beams whose ends are resting on cross-bars. The crossbars in turn are resting on self-contained supports (columns).

In the course of use, especially at high hot-blast temperatures and pressures, a considerable number of defects (over-heats, distortions, cracks) occur in the metal housings of the hot-blast main and the air heaters at the points where the connecting pipes join the trunk section of the main and the heaters. Elimination of overheats, cracks, etc. is difficult (due to the noxious and gas-polluted environment and high temperatures) and involves a considerable loss it necessitates product because of the disrupting the operation of the blast furnace. To avoid these disruptions it is necessary to prevent the major causes of overheats, distortions and cracks in the structures.

The rigidity of the hot-blast main structures in a horizontal plane precludes free displacement of its conjugated sections during heating. Stresses at the points of conjugation of these sections between each other and with the air heaters, as calculations and tests have revealed, exceed the yield limits of the grades of steel used to manufacture the housings of the structures.

The design of the supports which take the vertical loads induced by the mass of the hot-blast main proper is inherently substantially disadvantageous, because, in the course of operation, the load can be fully transmitted to the connecting pipes to cause their bending.

This results from the vertical displacement of the air heaters to which the connecting pipes are rigidly secured, as has been noted above.

The vertical displacement of the air heaters, regularly variable in the course of operation, is caused by the increased temperature (up to 100° C) of their housings and the cyclic operation of the air-heaters (blasting-heating).

Vertical displacement of the carrying beams from which the trunk section of the hot-blast main is suspended depends on the load transmitted to their supports, and also on daily and seasonal variations in the ambient air temperature.

The relative difference between the vertical displacements of the carrying beams and the hot-blast connecting pipes joining the air heaters is considerable (30–60 mm), depending on the difference in the level of installing the connecting pipes and the air heater base and also on the method of fixing the air heaters to the foundation.

The mass of the trunk section itself amounts to 10 tons per linear meter. Therefore the additional stresses in the housings due to the bending of the connecting pipes (100–200 ton load at 6–10 m arm) may exceed the yield limit of the grades of steel used to manufacture the housings, which leads to the recurrence of cracks and overheats, impairs the replacement of hot-blast valves fitted to the connecting pipes, and reduces the service life of the hot-blast main.

A supporting device for a hot-blast main is known which is intended for the elimination of the aforesaid disadvantages (Inventor's Certificate No. 357,334, USSR). The problem is solved by means of hydraulic cylinders which support the ends of the carrying beams; the cylinders are controlled through a follow-up system which senses the vertical displacements of the connecting pipes.

There are other structural designs of hot-blast mains which are known for eliminating the above-mentioned disadvantages. At blast temperatures of 1200° – 1400° C, these mains include supports in the trunk section located along the air heaters (in plan). The section is divided into separate lengths interconnected through temperature compensators in the form of corrugated steel shells with gaps in the refractory lining within their zones to compensate for displacements due to temperature variations. Each section is joined to the air heater by means of the connecting pipe, whereas each connecting pipe is additionally fitted with one or two temperature compensators similar to those described above. The hot-blast mains of this design are presently employed by producers in the Federal Republic of Germany, Japan, and France.

It should be noted, however, that all the above cited designs are complicated and costly. Thus, the application of hydraulic cylinders with follow-up systems involves the necessity of their constant attendance and adjustment.

The installation of temperature compensators results in longer connecting pipes, necessitates the use of additional supports for the compensators, and requires special holders to take up unbalanced forces arising due to the incresed internal blast pressure. All this adds much to the complexity and cost of the hot-blast main structures.

SUMMARY OF THE INVENTION

An object of the present invention is to improve the operational reliability of the hot-blast main structure.

Another object of the present invention is to simplify the hot-blast main structure and to make it less expensive.

These and other objects of the present invention are achieved in a supporting device for a blast-furnace hot-blast main having a trunk section rigidly connected to air heaters by means of connecting pipes comprising carrying beams resting on self-contained supports, and hot-blast main hangers whose ends are secured on the carrying beams. According to the invention, the ends of the hangers are secured on the carrying beams through pre-compressed springs whose pre-compression force is substantially equal to the mass of the hot-blast main section supported by the hanger, whereas the magnitude of the pre-compressed setting of the springs is several times larger than the maximum displacement of the connecting pipes when the air heaters are displaced vertically in the course of their operation.

The instant structure is simpler in design, less costly and at the same time no less efficient as compared with the known structures used to compensate for vertical displacements of the air heaters during their operation. Also, the application of pre-compressed springs makes unnecessary the use of either hydraulic cylinders or compensators on hot-blast connecting pipes.

It should be kept in mind that the cost of a single hydraulic cylinder or compensator is considerably higher than the cost of compression springs. By the installation of compression springs, it is possible not to use the hydraulic cylinders, the compensators with holders and the additional supports for the connecting pipes. As a result of not using the additional supports, the total length of the connecting pipes is reduced 12–15 m on the average. Simple compression springs are much more reliable and durable than hydraulic cylinders or multi-component devices, like the compensators for large diameter refractory-lined tubing. Additionally, compression springs require no attendance in use.

The lifting force of the pre-compressed springs constantly relieves the junction between the connecting pipes and the air heaters of the mass of the hot-blast main and prevents their destruction. The springs are pre-compressed so that the magnitude of their setting is several times higher (5–10 times) than the maximum vertical displacement of the air heaters. The lifting force of the springs proportional to the magnitude of their setting should be approximately equal to the full rates stress in the hangers from the mass of the hot-blast main structures. Then, in the course of operation, the junctions between the connecting pipes and the air heaters will receive no more tha 10–20% of the load caused by the mass of the suspended trunk section of the hot-blast main. This is because the major portion thereof will be constantly taken up by the carrying beams and will result in the reliable functioning of the hot-blast main.

Each compression spring may take form of a set of disk springs enclosed in a pipe covered with a metal plate and secured on the upper flange of the carrying beam. Each of springs has central through hole, wherein into one of the hanger ends is inserted and secured on the plate.

BRIEF DESCRIPTION OF THE DRAWINGS

Other objects and advantages of the present invention will be more clearly understood from the following detailed description of a specific embodiment given by way of example with reference to the accompanying drawings, in which.

DETAILED DESCRIPTION OF THE PREFERRED EMBODIMENTS

Figure 1:
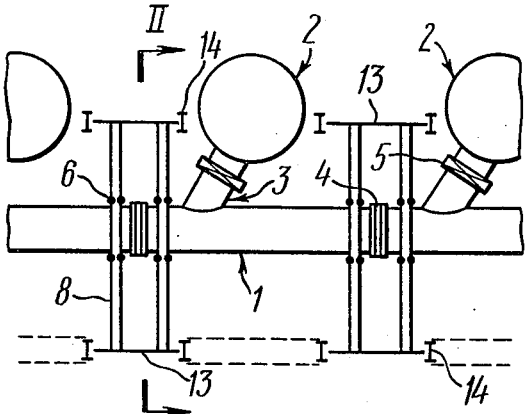
FIG. 1 is a schematic illustration, in plan, of a supporting device for a hot-blast main, according to the invention.
Figure 2:
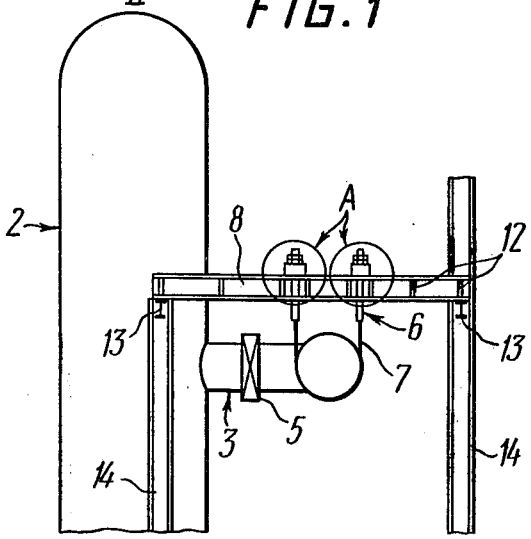
FIG. 2 is a sectional view taken along the line II—II in FIG. 1.

A trunk section 1 of a hot-blast main, supplying heated air to a blast furnace (not shown) is rigidly and airtightly connected to air heaters 2 by means of connecting pipes 3 (FIGS. 1 and 2). The section 1 and the connecting pipes 3 are made of large-diameter (1700 to 3500 mm) welded steel tubes lined inside with refractory materials. Each air heater 2 is a large-diameter (6000 to 14000 mm) assembly consisting of a welded steel housing and an inner lining, and is intended for heating air which is to be supplied to the blast furnace.

The section 1 is equipped with temperature compensators 4 in the form of corrugates steel shells welded airtightly to the housing of the section 1. The connecting pipes 3 are equipped with hot-blast valves 5 which are rigidly and airtightly joined with the housings of the connecting pipes 3 with the help of flanged bolted joints (not shown).

Figure 3:
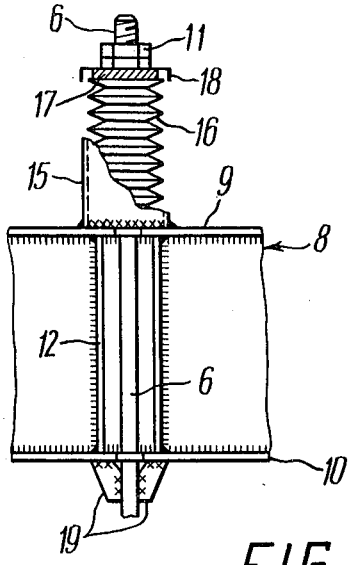
FIG. 3 shows unit A in FIG. 2 during mounting.
Figure 4:
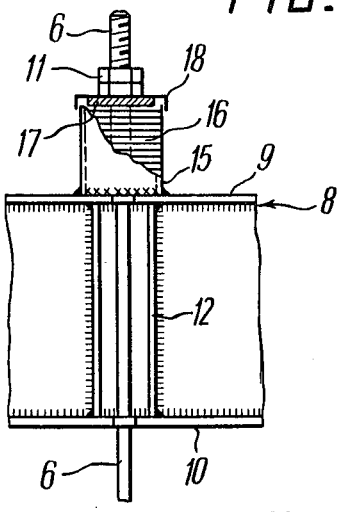
FIG. 4 shows unit A in FIG. 2 in the operating position.

The section 1 of the hot-blast main, by means of hangers consisting of flexible rods 6 and a metal sheet 7 (FIGS. 2–4) which envelopes the section 1, is suspended from carrying beams 8 having an upper 9 and lower 10 flanges. The ends of the flexible rods 6 are threaded for nuts 11.

The carrying beams 8 are welded, double-tee, channel or box-section, with webs 12. The beams rest on welded cross-bars 13 which, in turn, transmit the load to supports 14 having the shape of welded metal columns.

The upper flanges 9 of the carrying beams 8 mount metal pipes 15 which house compression springs, each of the springs being a set of disk springs 16 (FIGS. 3 and 4), or rail-carriage springs (not shown).

Mounted atop the springs 16 is a metal plate 17 with a cover 18 installed thereupon to protect the springs 16 from dust penetration inside the pipe 15.

The set of disk springs 16 has a central through hole coinciding with a hole in the beam 8 to insert the end of the flexible rod 6 which is secured on the plate 17 by means of the nut 11.

Initially, the hot-blast main is installed without a refractory lining and its height is fixed by the nuts 11; the springs 16 are not installed at this time.

Then, metal sheets 19 (FIG. 3) are welded to the lower flanges 10 of the carrying beams 8 and to the flexible rods 6. The welded joints of the sheets 19 are calculated to endure the full stress in the flexible rods 6 produced by the mass of the hot-blast main structures.

After mounting all the metal structures, equipment and refractory lining, the nuts 11 are removed. The springs 16 are installed inside the pipes 15; the plate 17 and the cover 18 (FIG. 3) are placed atop in succession. Thereafter, the nuts 11 are again screwed on the ends of the rods 6 and by means of the nuts the springs 16 are compressed so that the magnitude of their setting is several times higher, preferably 5–10 times, than the maximum displacement of the connecting pipes 3, caused by the vertical displacement of the air heaters 2 during their use. With this, the lifting force of the springs 16 directly proportional to the magnitude of their compression should be approximately equal to the full rated stress in the flexible rods 6 caused by the mass of the hot-blast main structures. Upon installing the springs 16 in their pre-compressed setting the sheets 19 are fully dismantled (FIG. 4), and the mass of the hot-blast main is fully brought to bear on the springs 16 through the medium of the rods 6, the nuts 11, the plate 17 and the cover 18 holding these springs 16 in the pre-compressed setting.

In the course of operation, the heating of the air in the heaters, up to 1200°–1400° C, leads to the corresponding heating (up to 100–150° C) of the housing of the air heaters 2 which in turn results in a vertical expansion of the latter. Cyclic vertical displacements of the housings of the air heaters 2 also take place under the action of the increased internal air pressure (up to 3–5 atm), as the air heaters 2 are alternately operated for blasting.

The lifting force of the pre-compressed springs 16 will constantly relieve the joints between the connecting pipes 3 and the air heaters 2. The vertical displacements of the air heaters 2 will somewhat reduce the magnitude of this lifting force due to the corresponding release of the springs 16, but due to their pre-compressed setting, which is 5–10 times larger than the maximum permissible displacement of the connecting pipes 3 together with the air heaters 2, the joints between the connecting pipes 3 and the air heaters 2 receive no more than 10–20% of the load produced by the mass of the suspended structures, thus ensuring their reliable functioning.

In certain cases, the necessity may arise to fully relieve the joints between the connecting pipes 3 and the air heaters 2 of the mass of the hot-blast main structures. It also is obvious that this problem can only be solved in a most simple and reliable way by using only the pre-compressed springs 16. In this case, the springs 16 are selected so that their pre-compressed setting can be increased even more as compared with the anticipated displacement of the connecting pipes 3. Thereby, the lifting force of the springs 16 increases correspondingly to exceed the stress caused in the hangers by the mass of the hot-blast main.

Reduced magnitude of the pre-compressed setting of the springs 16 with the respective reduction of their lifting force diminishes the effect of their use, because in this case the joints between the connecting pipes 3 and the air heaters 2 assume a larger portion of the load produced by the mass of the hot-blast main in the course of operation.

What we claim is:

1. In an installation for heating and supplying air to a blast furnace comprising: air heater; a blast-furnace hot-blast main comprising a trunk section; connecting pipes rigidly and airtightly connecting the air heaters to the trunk section; and a supporting device for the hot-blast main; the improvement wherein the supporting device comprises; a carrying beam; self-contained supports mounting the carrying beam; pre-compressed springs installed on the carrying beam; hangers of the hot-blast main secured on the carrying beam through the springs; the pre-compression force in the springs being substantially equal to the mass of the section of the hot-blast main supported by the hangers and the magnitude of the pre-compressed setting of the springs being several times larger than the maximum possible displacement of the connecting pipes when the air heaters are vertically displaced during their operation.

2. The installation as claimed in claim 1, wherein each of the pre-compressed springs comprises a set of disk springs; and further comprising: pipes mounted on an upper flange of the carrying beam, each of the pipes enclosing one set of the disk springs; and a metal plate mounted on top on each of the pipes; each set of disk springs having a central through hole so that one end of each of the hangers can be inserted through the central hole and secured on the plate.

3. The installation as claimed in claim 1, wherein each of the hangers comprises flexible metal rods and a metal sheet.

* * * * *